US007090955B2

(12) United States Patent
Tosaka et al.

(10) Patent No.: US 7,090,955 B2
(45) Date of Patent: Aug. 15, 2006

(54) BLACK TONER, IMAGE FORMING METHOD AND IMAGE FORMING APPARATUS USING THE TONER

(75) Inventors: Hachiro Tosaka, Sunto-gun (JP); Tomiaki Ito, Tagata-gun (JP); Yuji Natori, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/146,128

(22) Filed: Jun. 7, 2005

(65) Prior Publication Data

US 2005/0238981 A1 Oct. 27, 2005

Related U.S. Application Data

(62) Division of application No. 10/375,023, filed on Feb. 28, 2003.

(30) Foreign Application Priority Data

Mar. 1, 2002 (JP) ..... 2002-056315
Jul. 19, 2002 (JP) ..... 2002-210813

(51) Int. Cl.
*G03G 9/00* (2006.01)

(52) U.S. Cl. ..... 430/108.6; 430/111.41; 430/137.18; 430/137.19

(58) Field of Classification Search ..... 430/108.6, 430/111.41, 137.18, 137.19
See application file for complete search history.

(56) References Cited

U.S. PATENT DOCUMENTS

| | | | |
|---|---|---|---|
| 4,282,302 | A | 8/1981 | Makino et al. |
| 5,333,059 | A | 7/1994 | Hyosu et al. |
| 5,688,852 | A | 11/1997 | Misawa et al. |
| 6,432,589 | B1 | 8/2002 | Uchinokura et al. |
| 6,677,093 | B1 | 1/2004 | Yoshino et al. |
| 2004/0038142 | A1 | 2/2004 | Yoshida et al. |

FOREIGN PATENT DOCUMENTS

| | | |
|---|---|---|
| EP | P 0 952 494 A2 | 10/1999 |
| EP | 1 205 811 A2 | 5/2002 |

*Primary Examiner*—Mark A. Chapman
(74) *Attorney, Agent, or Firm*—Oblon, Spivak, McClelland, Maier & Neustadt, P.C.

(57) ABSTRACT

A toner for developing an electrostatic latent image, including toner particles each containing a black colorant and a binder resin, wherein the black colorant comprises a metal oxide having a number average particle diameter in the range of 20 to 100 nm in an amount of 10 to 40% by weight based on a total weight of the toner particles.

17 Claims, 1 Drawing Sheet

BLACK TONER, IMAGE FORMING METHOD AND IMAGE FORMING APPARATUS USING THE TONER

BACKGROUND OF THE INVENTION

This invention relates to a toner for developing an electrostatic latent image in electrophotography, electrostatic recording, electrostatic printing and so on, and to a method for producing the toner. More particularly, the present invention is directed to a black toner without using carbon black.

Carbon black has been conventionally used as a black colorant for a toner for developing an electrostatic latent image in image forming machines such as copying machines, laser printers and facsimile machines. However, because of a problem of carcinogenesis, the use of toners without carbon black has been long desired. While a magnetic material is a black colorant, the use thereof is limited to a magnetic toner. An organic black colorant such as aniline black and a Nigrosine dye has a problem because a high density image is not obtainable.

Japanese Patent No. 2736680 proposes a black metal oxide pigment composed of $Fe_2TiO_5$ and $Fe_2O_3$—$FeTiO_3$ and a particle diameter of 0.1 to 0.5 μm. While this black pigment is safe, non-magnetic and heat resistant, it is necessary to use a large amount, i.e. 40 to 60% by weight based on the weight of the toner, in order to obtain color density comparable to the known carbon black toner. Because of high specific gravity of the black pigment, however, the toner containing such a large amount of the black pigment has 1.4 to 1.8 times as great a specific gravity as that of the conventional carbon black toner. Thus, the black metal oxide pigment poses a lot of problems such as occurrence of abnormity in a toner density sensor or a toner amount sensor and short lifetime of carriers.

Japanese Patent No. 2997206 proposes a toner containing a black metal oxide pigment composed of oxides of cobalt, manganese and iron and having a specific surface area of 50 to 100 $m^2/g$. Because of the extremely fine particle size, this black pigment can afford image density comparable to the conventional carbon black colorant even when used in an amount of 10 to 30% based on the weight of the toner. However, the pigment is apt to form an aggregate and is not uniformly dispersed in the toner. As a consequence, the charging amount of the toner is insufficient and the developing efficiency is not good.

SUMMARY OF THE INVENTION

It is, therefore, an object of the present invention to provide a black toner which has solved the above drawbacks of the conventional black toner.

Another object of the present invention is to provide a black toner which does not use carbon black but which can give high quality images with image density comparable to that of the conventional carbon black toner.

It is a further object of the present invention to provide a black toner of the above mentioned type which is safe and heat resistant and which has a good developing efficiency and workability.

In accomplishing the foregoing objects, there is provided in accordance with one aspect of the present invention a toner for developing an electrostatic latent image, comprising toner particles each including a black colorant and a binder resin, wherein said black colorant comprises a metal oxide having a number average particle diameter in the range of 20 to 100 nm in an amount of 10 to 40% by weight based on a total weight of said toner particles.

In another aspect, the present invention provides a toner container containing the above toner.

The present invention also provides an image forming apparatus comprising the above toner container.

The present invention further provides an image forming method comprising developing an electrostatic latent image with the above toner.

The present invention further provides a method of preparing a toner, comprising mixing toner particles, each including black metal oxide colorant having a number average particle diameter d of $0.02\times10^{-6}$ to $0.100\times10^{-6}$ [m] and a binder resin, with fine metal oxide powder using a Henschel mixer for a period of time of T [second], said mixer comprising an inside wall defining a mixing chamber, and a rotating blade having a tip portion and disposed in said mixing chamber such that a clearance C [m] is defined between said tip portion and said inside wall, said mixer being operated such that said tip portion of said rotating blade moves at a peripheral speed of V [m/sec], wherein said number average particle diameter d, clearance C, peripheral speed V and mixing time T satisfy the following condition:

$$(C\times d)/(V\times T)\leqq 5\times10^{-13}.$$

BRIEF DESCRIPTION OF THE DRAWING

Other objects, features and advantages of the present invention will become apparent from the detailed description of the preferred embodiments of the invention which follows, when considered in the light of the accompanying drawing in which.

DETAILED DESCRIPTION OF THE PREFERRED EMBODIMENTS OF THE INVENTION

Figure 1:
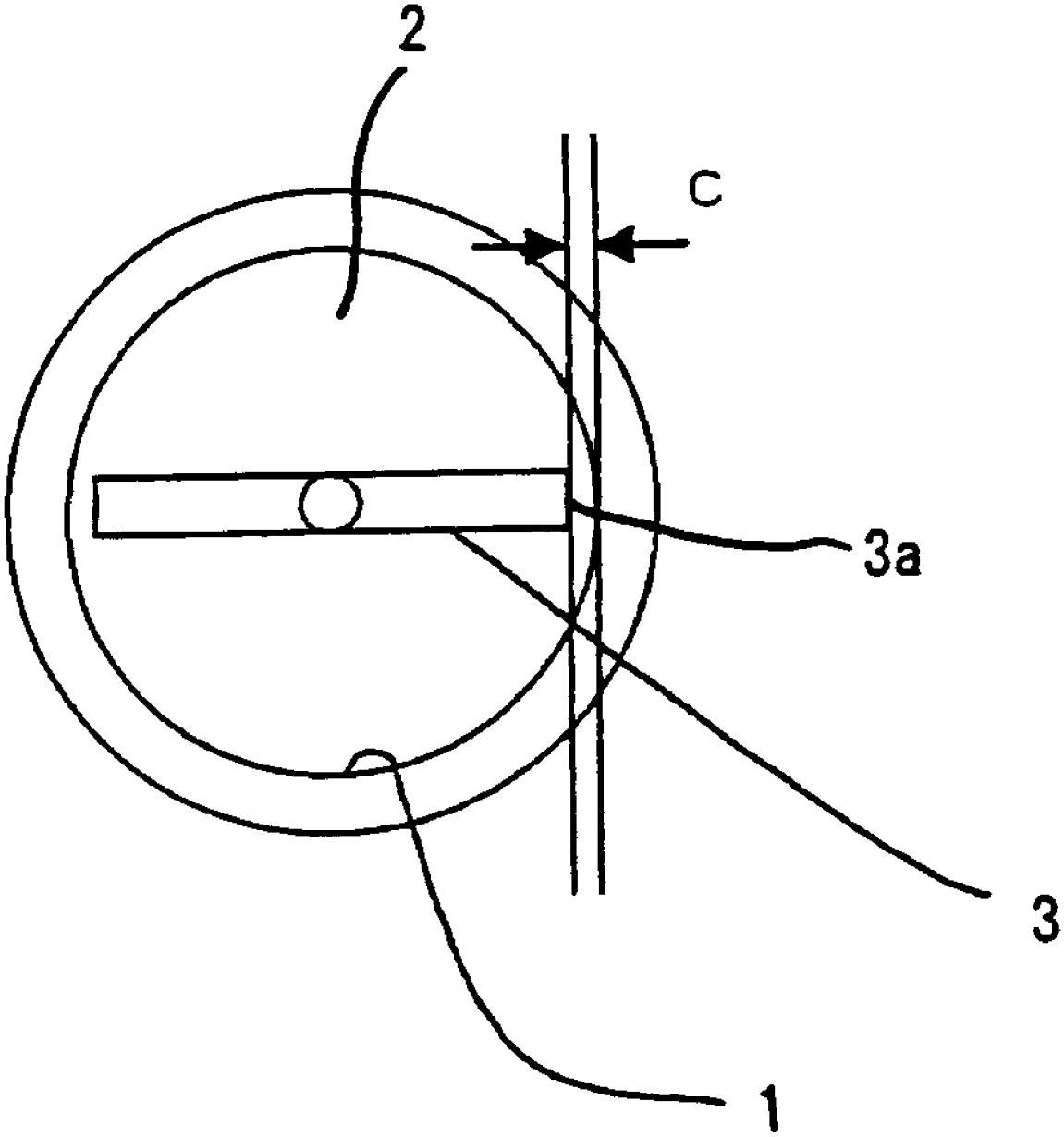
FIG. 1 is a sectional view diagrammatically illustrating a Henschel mixer used for mixing an external additive with toner particles.

A toner according to the present invention comprises toner particles each including a black metal oxide colorant and a binder resin.

The metal oxide colorant is preferably contains at least one oxide of a metal selected from Al, Si, Ti, V, Mn, Fe, Co, Cu, Nb, Mo and Sn. Examples of the metal oxide colorant include Mn-containing iron oxide pigments having a magnetite or hematite structure, $Fe_2O_3$—$Mn_2O_3$, sintered $TiO_2$, MnFe ferrite, polycrystalline particles composed of a mixed composition of $Fe_2TiO_5$ and $Fe_2O_3$—$FeTiO_3$ solid solution, surface coated products of the above polycrystalline particles having a coating of an oxide of at least one element selected from Al, Ti, Si, Zr and P, and composite metal oxide pigment having a spinel structure and containing Co, Fe, Cr and, optionally Mn.

It is important that the black metal oxide colorant have a number average particle diameter in the range of 20 to 100 nm. Too large a number average particle diameter of the black colorant in excess of 100 nm causes a reduction of an image density. When the number average particle diameter is below 20 nm, on the other hand, the colorant fails to uniformly disperse in the binder resin so that the charging amount of the toner is reduced to cause background stains (fogging) and an increase of the consumption of the toner.

The number average particle diameter as used herein is measured using a transmission electron microscope (TEM).

It is also important that the black metal oxide colorant be present in an amount of 10 to 40% by weight based on a total weight of the toner particles. Too small an amount of the black metal oxide colorant below 10% by weight fails to give a satisfactory image density. When the amount is above 40% by weight, the specific gravity of the toner becomes so high that, when the toner is used together with a carrier as a two-component developer, the service life of the carrier is reduced. For reasons of improved service life of the two-component developer, the amount of the black metal oxide colorant is preferably 10 to 30% by weight based on a total weight of the toner particles.

Preferably, the toner according to the present invention has a dielectric loss (tan δ) in the range of $3\times10^{-3}$ to $15\times10^{-3}$ for reasons of high image density while preventing background stains (fogging), increase of toner consumption and toner scattering.

As used herein, the dielectric loss (tan δ) is measured as follows:

Sample toner is pelletized at a pressure of 480 kg/cm$^2$ with a pelletizing device (MAEKAWA Testing Machine Type M). The pellet is on a solid electrode (SE-70 manufactured by Ando Denki Co., Ltd.) and measured for the capacitance (Ca) and conductance (Cd) using a dielectric loss meter (TR-10C manufactured by Ando Denki Co., Ltd.) at a frequency (f) of about 1 KHz. The dielectric loss is determined from the following equation:

$$\tan\delta = Ca/(2\pi\times f\times Cd).$$

The dielectric loss of the toner may be adjusted by controlling the amount of the black metal oxide colorant and/or an additive such as a charge controlling agent in the toner and conditions under which ingredients of the toner are mixed during preparation.

It is also preferred that the toner have saturation magnetization of not greater than 10 Am$^2$/Kg for reasons of high image density in the case where the toner is used as a two-component developer. The saturation magnetization as used herein is measured using a multi-sample rotary-type magnetization measuring device (Model REM-1 Type 1 manufactured by Toei Industry Co., Ltd.) in a magnetic field of 796 Am$^2$/Kg.

As the binder resin for use in the present invention, any resin known to be used conventionally for the preparation of a toner can be employed. Illustrative of suitable binder resins are styrene resins (homopolymers or copolymers containing styrene or its homologues) such as polystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic acid ester copolymer, styrene-methacrylic acid ester copolymer, styrene-α-methyl chloroacrylate copolymer, styrene-acrylonitrile-acrylic acid ester terpolymer; saturated polyester resins, unsaturated polyester resins, epoxy resins, vinyl chloride resins, rosin-modified maleic acid resins, phenol resins, polyethylene resins, polypropylene resins, petroleum resins, polyurethane resins, ketone resins, ethylene-ethylacrylate copolymer, xylene resins, kumaronic acid resins, chlorinated paraffins, and polyvinyl butyrate resins. The resins may used alone or in combination. Among these binder resins, polystyrene resins or epoxy resins are preferred.

For the purpose of improving releasing property, the toner may contain a wax. Any wax may be suitably used for the purpose of the present invention. Examples of such waxes include low molecular weight polyolefin waxes such as low molecular weight polyethylene wax and low molecular weight polypropylene wax; synthetic hydrocarbon waxes such as Fischer-Tropsh wax; natural waxes such as carnauba wax, candelilla wax, rice wax, montan wax, Jojoba wax, bees wax, lanolin and spermaceti; mineral waxes such as montan wax and ozokerite; higher fatty acid waxes such as hydrogenated castor oil, hydroxystearic acid, palmitic acid and millystyric acid; and metal salts, phenol esters or amides of higher fatty acids. These waxes may be used singly or in combination of two or more thereof. The amount of the wax is generally 0 to 20% by weight, preferably 1–10% by weight, based on the weight of the toner.

The toner of the present invention may contain a charge controlling agent, if desired. Any charge controlling agent generally used in the field of toners for use in electrograph may be used. Examples of charge controlling agents include positive charge imparting agents such a Nigrosine dye, a quaternary ammonium salt including a fluorine-modified quaternary ammonium salt, a basic dye and amino group-containing polymer; and negative charge imparting agents such as chromium-containing monoazo dye, chromium-containing organic dye and metal salts of salicylic acid compounds. The amount of the charge controlling agent is generally 0.1 to 20% by weight, preferably 0.1 to 10% by weight, based on the weight of the toner, for reasons of obtaining proper charging characteristics.

The toner of the present invention may be mixed with an external additive for the purposes of improving the fluidity and so on. Inorganic fine particles may be suitably used as the external additive. Examples of inorganic fine particles include silica, alumina, titanium oxide, barium titanate, magnesium titanate, calcium titanate, strontium titanate, zinc oxide, tin oxide, quartz sand, clay, mica, wallstonite, diatomaceous earth, chromium oxide, cerium oxide, iron oxide red, antimony trioxide, magnesium oxide, zirconium oxide, barium sulfate, barium carbonate, calcium carbonate, copper oxide, barium oxide, calcium oxide, potassium oxide, sodium oxide, magnesium carbonate, magnesium sulfate, $CaO.SiO_2$, $K_2O.(TiO_2)_n$, $Al_2O_3.2SiO_2$, silicon carbide and silicon nitride. Above all, silica, titania or alumina is preferably used. These inorganic fine particles preferably have a primary particle diameter of 5 mμ (5 nm) to 2 μm, more preferably 5 mμ to 500 mμ. By subjecting these external additives, in particular fine metal oxide powder, to a surface treatment to improve the hydrophobic properties thereof, deterioration of the fluidity and the charge properties of the toner can be avoided even under high humidity conditions. Suitable surface treating agents include silane coupling agents, silylating agents, silane coupling agents having a fluorinated alkyl group, silicon oil, organic titanate type coupling agents, and aluminum type coupling agents. Hydrophobic silica is the most preferred external additive for the purpose of the present invention.

The inorganic fine particles are used in an amount of generally 0.2 to 5% by weight, preferably 0.3 to 3% by weight, based on the weight of the toner.

The external additive may also be fine particles of a polymeric substance such as polystyrene, polyolefins, polytetrafluoroethylene, polymethacrylate or an acrylate copolymer obtained by soap-free emulsion polymerization, suspension polymerization or dispersion polymerization; silicone, benzoguanamine or nylon obtained by polycondensation, zinc stearate, or a thermosetting resin.

When the above hydrophobic fine metal oxide powder is used as the external additive, it is preferred that the fine metal oxide powder be attached to the toner particles to provide a detaching rate of 30% by weight or less. The term "detaching rate" as used herein is intended to refer to an amount of the fine metal oxide powder detached from the toner particles, when the toner is sonicated in an aqueous medium containing 1% by weight of a surfactant at a frequency of 38 kHz and a power of 120 W for 10 minutes.

More particularly, the detaching rate is measured as follows. Sample toner (4 g) is dispersed in 400 ml of an aqueous solution containing 0.1% of a surfactant (DRY-WELL manufactured by Fuji Film Inc.). The mixture is then subjected to ultrasonic vibration at a frequency of 38 kHz and a power of 120 W for 10 minutes for 10 minutes using an ultrasonic washing device (manufactured by NND Inc.). The sonicated mixture is then allowed to quiescently stand for 24 hours to permit the toner particles to settle. The supernatant is removed and the wet solids are dried in air at 23° C. and a relative humidity of 65% for at least 24 hours. The dried toner particles (3 g) are pelletized at a pressure of 480 kg/cm$^2$ with a pelletizing device (MAEKAWA Testing Machine Type M). The pellet is measured for the content of the external additive using fluorescent X-ray analyzer (manufactured by Shimadzu Corporation; X-ray power: 40 kV, 10 mA). In the case of hydrophobic silica, for example, the amount of Si is measured from the fluorescent X-ray intensity using a previously prepared calibration curve. The detaching rate RD is calculated as follows:

$$RD=(W0-W1)/W0\times 100(\%)$$

where W0 and W1 are the weights of the external additive before and after the sonication, respectively.

When the detaching rate is 30% by weight or less, the toner gives high quality images not only in the initial stage but also after repeated use for long runs. The detaching rate may be adjusted by controlling mixing force (control of shear rate of a mixer for mixing the external additive and the toner particles) and mixing time (control of the operation time and number of the mixer).

When the above hydrophobic fine metal oxide powder is used as the external additive, it is also preferred that the fine metal oxide powder be attached to the toner particles using a Henschel mixer as shown in FIG. 1. The mixer comprises an inside wall 1 defining a mixing chamber 2, and a rotating blade 3 having a tip portion 3*a* and disposed in the mixing chamber 2 such that a clearance C [m] is defined between the tip portion 3*a* and the inside wall 1. The mixer is operated for a period of time of T [second] such that the tip portion 3*a* of the rotating blade 3 moves at a peripheral speed of V [m/sec]. In this case, it is preferred that the clearance C, peripheral speed V and mixing time T satisfy the following condition:

$$(C\times d)/(V\times T)\leqq 5\times 10^{-13}\ [\mathrm{m}]$$

where d is the number average particle diameter [m].

The clearance C is preferably 0.001 to 0.02 m. The peripheral speed V is preferably 5 to 100 m/sec. The mixing time T is preferably 10 to 1500 seconds. The mixing time T is a total of the actual mixing time when the mixing is operated intermittently. The number average particle diameter d is $0.02\times 10^{-6}$ to $0.1\times 10^{-6}$ (20 to 100 nm).

The toner according to the present invention preferably has a bulk density of 0.200 g/cm$^3$ to 0.500 g/cm$^3$, more preferably 0.350 g/cm$^3$ to 0.450 g/cm$^3$, for reasons of reduction of toner scattering and background stains.

The toner according to the present invention may be used by itself as a one-component toner or may be used together with a carrier as a two-component developer. As a carrier, there may be used iron powder, glass beads, ferrite powder, nickel powder or a product obtained by applying a resin coating on any of these powder and beads.

The following examples will further illustrate the present invention. Parts are by weight. In the examples, the image density, color-reproducibility and particle diameter of toner are measured as follows:

Image Density:

An image is fixed on a recording paper such that the amount of the toner of the image is 1.0 mg/cm$^2$. The image density at the toner mass of 1.0 mg/cm$^2$ is measured with an X-Rite 938 spectrodensitometer using DEN color system at "A" response.

Color Reproducibility:

Color reproducibility in terms of a* and b* values is measured with an X-Rite 938 spectrodensitometer, using D50 illuminant and CIE 2-degree observer at a color density of 0.8.

Particle Diameter:

The volume average particle diameter herein is measured using Multisizer E (manufactured by Coulter Electronics Inc.) with a 100 μm aperture tube.

EXAMPLE 1

| | |
|---|---|
| Polyester resin | 71 parts |
| Polyethylene wax | 5 parts |
| MnFe Ferrite (number average particle diameter: 72 nm, saturation magnetization: 0.2 Am$^2$/Kg) | 23 parts |
| Negative charge controlling agent | 1 part |

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having a dielectric loss δ of $12\times 10^{-3}$ and a true specific gravity of 1.44 g/cm$^3$ was selected. The selected toner particles (100 parts) were then mixed with 0.6 part of hydrophobic silica to obtain a toner. This toner was charged in a toner container of an image forming machine (imagio MF2230 manufactured by Ricoh Company, Ltd.), and an image was produced. The image was found to have an image density of 1.40 and color reproducibility of a*=0.1, b*=−0.5. Thus the image quality was comparable to that obtained by using the conventional carbon black toner. The consumption of the toner and carrier service life were tested by repeatedly producing images for long runs. The results were similar to those obtained by using the conventional carbon black toner.

EXAMPLE 2

| | |
|---|---|
| Polyester resin | 76 parts |
| Carbauna wax | 5 parts |
| TiFe Ferrite (number average particle diameter: 96 nm, saturation magnetization: 3.0 Am$^2$/Kg) | 23 parts |
| Metal salt of salicylic acid compound | 3 parts |

The above composition was mixed using a Henschel mixer under various conditions to obtain premixed materials having different degrees of mixing state and each having a weight particle diameter of 9.0 μm. Each of the premixed materials was melted, kneaded with a dual axis kneader, solidified, ground and classified. From the thus obtained various kinds of toner particles having different degree of mixing state, one kind of toner particles having a dielectric loss δ of $3\times10^{-3}$ and a true specific gravity of 1.36 g/cm$^3$ was selected. The selected toner particles (100 parts) were then mixed with 0.5 part of hydrophobic silica to obtain a toner. This toner was charged in a toner container of an image forming machine (imagio MF2230 manufactured by Ricoh Company, Ltd.), and an image was produced. The image was found to have an image density of 1.33 and color reproducibility of a*=−0.0, b*=−0.2. Thus the image quality was comparable to that obtained by using the conventional carbon black toner. The consumption of the toner and carrier service life were tested by repeatedly producing images for long tuns. The results were similar to those obtained by using the conventional carbon black toner.

EXAMPLE 3

| | |
|---|---|
| Polyester resin | 74 parts |
| Polyethylene wax | 5 parts |
| $Fe_2O_3$—$Mn_2O_3$ (number average particle diameter: 55 nm, saturation magnetization: 2.0 Am$^2$/Kg) | 20 parts |
| Negative charge controlling agent | 1 part |

The above composition was mixed using a Henschel mixer under various conditions to obtain premixed materials having different degrees of mixing state and each having a weight particle diameter of 11.5 μm. Each of the premixed materials was melted, kneaded with a dual axis kneader, solidified, ground and classified. From the thus obtained various kinds of toner particles having different degree of mixing state, one kind of toner particles having a dielectric loss δ of $4\times10^{-3}$ and a true specific gravity of 1.41 g/cm$^3$ was selected. The selected toner particles (100 parts) were then mixed with 0.4 part of hydrophobic silica to obtain a toner. This toner was charged in a toner container of an image forming machine (imagio MF2230 manufactured by Ricoh Company, Ltd.), and an image was produced. The image-was found to have an image density of 1.35 and color reproducibility of a*=−0.1, b*=−0.3. Thus the image quality was comparable to that obtained by using the conventional carbon black toner. The consumption of the toner and carrier service life were tested by repeatedly producing images for long runs. The results were similar to those obtained by using the conventional carbon black toner.

EXAMPLE 4

| | |
|---|---|
| Styrene-acrylate resin | 67 parts |
| Low molecular weight polypropylene | 5 parts |
| Titanium oxide sintered material (number average particle diameter: 30 nm, saturation magnetization: 0.5 Am$^2$/Kg) | 27 parts |
| Negative charge controlling agent | 1 part |

The above composition was mixed using a Henschel mixer under various conditions to obtain premixed materials having different degrees of mixing state and each having a weight particle diameter of 5.5 μm. Each of the premixed materials was melted, kneaded with a dual axis kneader, solidified, ground and classified. From the thus obtained various kinds of toner particles having different degree of mixing state, one kind of toner particles having a dielectric loss δof $13\times10^{-3}$ and a true specific gravity of 1.51 g/cm$^3$ was selected. The selected toner particles (100 parts) were then mixed with 0.9 part of hydrophobic silica to obtain a toner. This toner was charged in a toner container of an image forming machine (imagio MF2230 manufactured by Ricoh Company, Ltd.), and an image was produced. The image was found to have an image density of 1.42 and color reproducibility of a*=−0.2, b*=−0.3. Thus the image quality was comparable to that obtained by using the conventional carbon black toner. The consumption of the toner and carrier service life were tested by repeatedly producing images for long runs. The results were similar to those obtained by using the conventional carbon black toner.

EXAMPLE 5

| | |
|---|---|
| Polyester resin | 54 parts |
| Carbauna wax | 5 parts |
| TiFe Ferrite (number average particle diameter: 72 nm, saturation magnetization: 0.5 Am$^2$/Kg) | 40 parts |
| Negative charge controlling agent | 1 part |

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having a dielectric loss δ of $10\times10^{-3}$ and a true specific gravity of 1.72 g/cm$^3$ was selected. The selected toner particles (100 parts) were then mixed with 0.6 part of hydrophobic silica to obtain a toner. This toner was charged in a toner container of an image forming machine (imagio MF2230 manufactured by Ricoh Company, Ltd.), and an image was produced. The image was found to have an image density of 1.45 and color reproducibility of a*=0.1, b*=0.0. Thus the image quality was comparable to that obtained by using the conventional carbon black toner. The consumption of the toner and carrier service life were tested by repeatedly producing images for long runs. The results of the toner consumption were similar to those obtained by using the conventional carbon black toner. However, the carrier life was about 90% of that of the conventional carbon black toner.

Comparative Example 1

| | |
|---|---|
| Polyester resin | 74 parts |
| Polyethylene wax | 5 parts |
| MnFe Ferrite (number average particle diameter: 15 nm, saturation magnetization: 0.2 Am$^2$/Kg) | 20 parts |
| Negative charge controlling agent | 1 part |

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having the lowest dielectric loss δ of $20\times10^{-3}$ and a true specific gravity of 1.41 g/cm$^3$ was selected. The selected toner particles (100 parts) were then mixed with 0.6 part of hydrophobic silica to obtain a toner. This toner was charged in a toner container of an image forming machine (imagio MF2230 manufactured by Ricoh Company, Ltd.), and an image was produced. The image was found to have an image density of 1.45 and color reproducibility of a*=−0.1, b*=−0.2. Thus the image quality was comparable to that obtained by using the conventional carbon black toner. The consumption of the toner was tested by repeatedly producing images for long runs. The consumption was 1.5 times as large as that of the conventional carbon black toner.

Comparative Example 2

| | |
|---|---|
| Polyester resin | 74 parts |
| Polyethylene wax | 5 parts |
| MnFe Ferrite (number average particle diameter: 140 nm, saturation magnetization: 0.2 Am$^2$/Kg) | 20 parts |
| Negative charge controlling agent | 1 part |

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having a dielectric loss δ of $6\times10^{-3}$ and a true specific gravity of 1.42 g/cm$^3$ was selected. The selected toner particles (100 parts) were then mixed with 0.6 part of hydrophobic silica to obtain a toner. This toner was charged in a toner container of an image forming machine (imagio MF2230 manufactured by Ricoh Company, Ltd.), and an image was produced. The image was found to have an image density of 1.15 and color reproducibility of a*=0.2, b*=0.1. Thus the image quality was not good as compared with the conventional carbon black toner.

Comparative Example 3

| | |
|---|---|
| Polyester resin | 44 parts |
| Polyethylene wax | 5 parts |
| TiFe Ferrite (number average particle diameter: 120 nm, saturation magnetization: 0.5 Am$^2$/Kg) | 50 parts |
| Negative charge controlling agent | 1 part |

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having a dielectric loss δ of $8\times10^{-3}$ and a true specific gravity of 1.89 g/cm$^3$ was selected. The selected toner particles (100 parts) were then mixed with 0.6 part of hydrophobic silica to obtain a toner. This toner was charged in a toner container of an image forming machine (imagio MF2230 manufactured by Ricoh Company, Ltd.), and an image was produced. The image was found to have an image density of 1.42 and color reproducibility of a*=0.3, b*=−0.6. Thus the image quality was comparable to that obtained by using the conventional carbon black toner. The consumption of the toner and carrier service life were tested by repeatedly producing images for long runs. The results of the toner consumption were similar to those obtained by using the conventional carbon black toner. However, the carrier life was about 60% of that of the conventional carbon black toner.

Comparative Example 4

| | |
|---|---|
| Polyester resin | 74 parts |
| Polyethylene wax | 5 parts |
| TiFe Ferrite (number average particle diameter: 72 nm, saturation magnetization: 0.5 Am$^2$/Kg) | 20 parts |
| Negative charge controlling agent | 1 part |

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having a dielectric loss δ of $2\times10^{-3}$ and a true specific gravity of 1.40 g/cm$^3$ was selected. The selected toner particles (100 parts) were then mixed with 0.6 part of hydrophobic silica to obtain a toner. This toner was charged in a toner container of an image forming machine (imagio MF2230 manufactured by Ricoh Company, Ltd.), and an image was produced. The image was found to have an image density of 1.15 and color reproducibility of a*=−0.4, b*=0.3. Thus the image quality was not good as compared with the conventional carbon black toner.

Comparative Example 5

| | |
|---|---|
| Polyester resin | 74 parts |
| Polyethylene wax | 5 parts |
| TiFe Ferrite (number average particle diameter: 72 nm, saturation magnetization: 0.5 Am$^2$/Kg) | 20 parts |
| Negative charge controlling agent | 1 part |

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having a dielectric loss δ of $30\times10^{-3}$ and a true specific gravity of 1.41 g/cm$^3$ was selected. The selected toner particles (100 parts) were then mixed with 0.6 part of hydrophobic silica to obtain a toner. This toner was charged in a toner container of an image forming machine (imagio MF2230 manufactured by Ricoh Company, Ltd.), and an image was produced. The image was found to have an image density of 1.45 and color reproducibility of a*=−0.5, b*=0.2. Thus the image quality was comparable to that obtained by using the conventional carbon black toner. The consumption of the toner was tested by repeatedly producing images for long runs. The toner consumption was about 2 times as large as that of the conventional carbon black toner.

Comparative Example 6

| | |
|---|---|
| Polyester resin | 86 parts |
| Polyethylene wax | 5 parts |
| TiFe Ferrite (number average particle diameter: 100 nm, saturation magnetization: 0.5 $Am^2/Kg$) | 8 parts |
| Negative charge controlling agent | 1 part |

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having a dielectric loss δ of $2\times10^{-3}$ and a true specific gravity of 1.40 $g/cm^3$ was selected. The selected toner particles (100 parts) were then mixed with 0.6 part of hydrophobic silica to obtain a toner. This toner was charged in a toner container of an image forming machine (imagio MF2230 manufactured by Ricoh Company, Ltd.), and an image was produced. The image was found to have an image density of 1.05 and color reproducibility of a*=−0.2, b*=−0.4. Thus the image quality was not good as compared with the conventional carbon black toner.

EXAMPLE 7

| | |
|---|---|
| Polyester resin | 71 parts |
| Polyethylene wax | 5 parts |
| MnFe Ferrite (number average particle diameter: 72 nm, saturation magnetization: 0.2 $Am^2/Kg$) | 23 parts |
| Negative charge controlling agent | 1 part |

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having a dielectric loss δ of $12\times10^{-3}$ and a true specific gravity of 1.44 $g/cm^3$ was selected. The selected toner particles (100 parts) were then mixed with 0.5 part of hydrophobic silica under the following conditions to obtain a toner.

Henschel mixer: Type 20B

Revolution speed of the mixer: 1890 rpm

Operation pattern: operated for 30 seconds and then stopped for 60 seconds

Mixing time: the above operation was repeated 12 times.

The thus obtained toner was found to have a detaching rate of 0.05%. The toner was charged in a toner container of an image forming machine (imagio MF2230 manufactured by Ricoh Company, Ltd.), and an image was produced. The image was found to have an image density of 1.35 and color reproducibility of a*=−0.1, b*=−0.5. Thus the image quality was comparable to that obtained by using the conventional carbon black toner. The image production was repeated for 60,000 runs. The 60,000th image had an image density of 1.34 and good color reproducibility. The toner consumption and carrier life were good. Also measured were toner scattering and background stains. The results are summarized in Table 1.

EXAMPLE 8

| | |
|---|---|
| Polyester resin | 71 parts |
| Polyethylene wax | 5 parts |
| MnFe Ferrite (number average particle diameter: 72 nm, saturation magnetization: 0.2 $Am^2/Kg$) | 23 parts |
| Negative charge controlling agent | 1 part |

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having a dielectric loss δ of $12\times10^{-3}$ and a true specific gravity of 1.44 $g/cm^3$ was selected. The selected toner particles (100 parts) were then mixed with 0.8 part of hydrophobic silica under the following conditions to obtain a toner.

Henschel mixer: Type 20B

Revolution speed of the mixer: 1890 rpm

Operation pattern: operated for 30 seconds and then stopped for 60 seconds

Mixing time: the above operation was repeated 12 times.

The thus obtained toner was found to have a detaching rate of 0.08%. The toner was charged in a toner container of an image forming machine (imagio MF2230 manufactured by Ricoh Company, Ltd.), and an image was produced. The image was found to have an image density of 1.33 and color reproducibility of a*=−0.1, b*=−0.5. Thus the image quality was comparable to that obtained by using the conventional carbon black toner. The image production was repeated for 60,000 runs. The 60,000th image had an image density of 1.34 and good color reproducibility. The toner consumption and carrier life were good. Also measured were toner scattering and background stains. The results are summarized in Table 1.

EXAMPLE 9

| | |
|---|---|
| Polyester resin | 76 parts |
| Carnauba wax | 5 parts |
| TiFe Ferrite (number average particle diameter: 96 nm, saturation magnetization: 3.0 $Am^2/Kg$) | 23 parts |
| Metal salt of salicylic acid compound | 3 parts |

The above composition was mixed using a Henschel mixer under various conditions to obtain premixed materials having different degrees of mixing state and each having a weight particle diameter of 9.0 μm. Each of the premixed materials was melted, kneaded with a dual axis kneader, solidified, ground and classified. From the thus obtained various kinds of toner particles having different degree of mixing state, one kind of toner particles having a dielectric loss δ of $3\times10^{-3}$ and a true specific gravity of 1.36 g/cm$^3$ was selected. The selected toner particles (100 parts) were then mixed with 0.6 part of hydrophobic silica under the following conditions to obtain a toner.

Henschel mixer: Type 20B

Revolution speed of the mixer: 1890 rpm

Operation pattern: operated for 30 seconds and then stopped for 60 seconds

Mixing time: the above operation was repeated 12 times.

The thus obtained toner was found to have a detaching rate of 0.05%. The toner was charged in a toner container of an image forming machine (imagio MF2230 manufactured by Ricoh Company, Ltd.), and an image was produced. The image was found to have an image density of 1.33 and color reproducibility of a*=−0.0, b*=−0.2. Thus the image quality was comparable to that obtained by using the conventional carbon black toner. The image production was repeated for 60,000 runs. The 60,000th image had an image density of 1.33 and good color reproducibility. The toner consumption and carrier life were good. Also measured were toner scattering and background stains. The results are summarized in Table 1.

EXAMPLE 10

| | |
|---|---|
| Polyester resin | 74 parts |
| Polyethylene wax | 5 parts |
| $Fe_2O_3$—$Mn_2O_3$ (number average particle diameter: 55 nm, saturation magnetization: 2.0 Am$^2$/Kg) | 20 parts |
| Negative charge controlling agent | 1 part |

The above composition was mixed using a Henschel mixer under various conditions to obtain premixed materials having different degrees of mixing state and each having a weight particle diameter of 11.5 μm. Each of the premixed materials was melted, kneaded with a dual axis kneader, solidified, ground and classified. From the thus obtained various kinds of toner particles having different degree of mixing state, one kind of toner particles having a dielectric loss δ of $4\times10^{-3}$ and a true specific gravity of 1.41 g/cm$^3$ was selected. The selected toner particles (100 parts) were then mixed with 0.5 part of hydrophobic silica under the following conditions to obtain a toner.

Henschel mixer: Type 20B

Revolution speed of the mixer: 1890 rpm

Operation pattern: operated for 30 seconds and then stopped for 60 seconds

Mixing time: the above operation was repeated 12 times.

The thus obtained toner was found to have a detaching rate of 0.05%. The toner was charged in a toner container of an image forming machine (imagio MF2230 manufactured by Ricoh Company, Ltd.), and an image was produced. The image was found to have an image density of 1.38 and color reproducibility of a*=−0.1, b*=−0.3. Thus the image quality was comparable to that obtained by using the conventional carbon black toner. The image production was repeated for 60,000 runs. The 60,000th image had an image density of 1.35 and good color reproducibility. The toner consumption and carrier life were good. Also measured were toner scattering and background stains. The results are summarized in Table 1.

EXAMPLE 11

| | |
|---|---|
| Styrene-acrylate resin | 67 parts |
| Low molecular weight polypropylene | 5 parts |
| Titanium oxide sintered material (number average particle diameter: 30 nm, saturation magnetization: 0.5 Am$^2$/Kg) | 27 parts |
| Negative charge controlling agent | 1 part |

The above composition was mixed using a Henschel mixer under various conditions to obtain premixed materials having different degrees of mixing state and each having a weight particle diameter of 5.5 μm. Each of the premixed materials was melted, kneaded with a dual axis kneader, solidified, ground and classified. From the thus obtained various kinds of toner particles having different degree of mixing state, one kind of toner particles having a dielectric loss δ of $13\times10^{-3}$ and a true specific gravity of 1.51 g/cm$^3$ was selected. The selected toner particles (100 parts) were then mixed with 0.5 part of hydrophobic silica under the following conditions to obtain a toner.

Henschel mixer: Type 20B

Revolution speed of the mixer: 1890 rpm

Operation pattern: operated for 30 seconds and then stopped for 60 seconds

Mixing time: the above operation was repeated 12 times.

The thus obtained toner was found to have a detaching rate of 0.05%. The toner was charged in a toner container of an image forming machine (imagio MF2230 manufactured by Ricoh Company, Ltd.), and an image was produced. The image was found to have an image density of 1.42 and color reproducibility of a*=−0.2, b*=−0.3. Thus the image quality was comparable to that obtained by using the conventional carbon black toner. The image production was repeated for 60,000 runs. The 60,000th image had an image density of 1.40 and good color reproducibility. The toner consumption and carrier life were good. Also measured were toner scattering and background stains. The results are summarized in Table 1.

EXAMPLE 12

| | |
|---|---|
| Polyester resin | 54 parts |
| Carbauna wax | 5 parts |
| TiFe Ferrite (number average particle diameter: 96 nm, saturation magnetization: 3.0 Am$^2$/Kg) | 16 parts |
| Metal salt of salicylic acid compound | 3 parts |

The above composition was mixed using a Henschel mixer under various conditions to obtain premixed materials having different degrees of mixing state and each having a weight particle diameter of 9.0 μm. Each of the premixed materials was melted, kneaded with a dual axis kneader, solidified, ground and classified. From the thus obtained various kinds of toner particles having different degree of mixing state, one kind of toner particles having a dielectric loss δ of $3\times10^{-3}$ and a true specific gravity of 1.36 g/cm$^3$ was selected. The selected toner particles (100 parts) were then mixed with 0.5 part of hydrophobic silica under the following conditions to obtain a toner.

Henschel mixer: Type 20B

Revolution speed of the mixer: 1890 rpm

Operation pattern: operated for 30 seconds and then stopped for 60 seconds

Mixing time: the above operation was repeated 12 times.

The thus obtained toner was found to have a detaching rate of 0.05%. The toner was charged in a toner container of an image forming machine (imagio MF2230 manufactured by Ricoh Company, Ltd.), and an image was produced. The image was found to have an image density of 1.35 and color reproducibility of a*=−0.0, b*=−0.2. Thus the image quality was comparable to that obtained by using the conventional carbon black toner. The image production was repeated for 60,000 runs. The 60,000th image had an image density of 1.33 and good color reproducibility. The toner consumption and carrier life were good. Also measured were toner scattering and background stains. The results are summarized in Table 1.

EXAMPLE 13

| | |
|---|---|
| Polyester resin | 71 parts |
| Polyethylene wax | 5 parts |
| MnFe Ferrite (number average particle diameter: 72 nm, saturation magnetization: 0.2 $Am^2/Kg$) | 23 parts |
| Negative charge controlling agent | 1 part |

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having a dielectric loss δ of $12\times10^{-3}$ and a true specific gravity of 1.44 $g/cm^3$ was selected. The selected toner particles (100 parts) were then mixed with 0.5 part of hydrophobic silica under the following conditions to obtain a toner.

Henschel mixer: Type 20B

Revolution speed of the mixer: 1890 rpm

Operation pattern: operated for 30 seconds and then stopped for 60 seconds

Mixing time: the above operation was repeated 8 times.

The thus obtained toner was found to have a detaching rate of 0.14%. The toner was charged in a toner container of an image forming machine (imagio MF2230 manufactured by Ricoh Company, Ltd.), and an image was produced. The image was found to have an image density of 1.35 and color reproducibility of a*=−0.1, b*=−0.5. Thus the image quality was comparable to that obtained by using the conventional carbon black toner. The image production was repeated for 60,000 runs. The 60,000th image had an image density of 1.34 and good color reproducibility. The toner consumption and carrier life were good. Also measured were toner scattering and background stains. The results are summarized in Table 1.

Comparative Example 7

| | |
|---|---|
| Polyester resin | 74 parts |
| Polyethylene wax | 5 parts |
| TiFe Ferrite (number average particle diameter: 72 nm, saturation magnetization: 0.5 $Am^2/Kg$) | 20 parts |
| Negative charge controlling agent | 1 part |

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having a dielectric loss δ of $2\times10^{-3}$ and a true specific gravity of 1.40 $g/cm^3$ was selected. The selected toner particles (100 parts) were then mixed with 0.6 part of hydrophobic silica under the following conditions to obtain a toner.

Henschel mixer: Type 20B

Revolution speed of the mixer: 1890 rpm

Operation pattern: operated for 30 seconds and then stopped for 60 seconds

Mixing time: the above operation was conducted only once.

The thus obtained toner was found to have a detaching rate of 0.20%. The toner was charged in a toner container of an image forming machine (imagio MF2230 manufactured by Ricoh Company, Ltd.), and an image was produced. The image was found to have an image density of 1.15 and color reproducibility of a*=−0.4, b*=0.3. The image production was repeated for 60,000 runs. Good image quality was not obtainable after long runs. The results are summarized in Table 1.

Comparative Example 8

| | |
|---|---|
| Polyester resin | 74 parts |
| Polyethylene wax | 5 parts |
| TiFe Ferrite (number average particle diameter: 72 nm, saturation magnetization: 0.5 $Am^2/Kg$) | 20 parts |
| Negative charge controlling agent | 1 part |

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having a dielectric loss δ of $30\times10^{-3}$ and a true specific gravity of 1.41 $g/cm^3$ was selected. The selected toner particles (100 parts) were then mixed with 0.6 part of hydrophobic silica under the following conditions to obtain a toner.

Henschel mixer: Type 20B

Revolution speed of the mixer: 1890 rpm

Operation pattern: operated for 30 seconds and then stopped for 60 seconds

Mixing time: the above operation was conducted only once.

The thus obtained toner was found to have a detaching rate of 0.20%. The toner was charged in a toner container of an image forming machine (imagio MF2230 manufactured by Ricoh Company, Ltd.), and an image was produced. The image was found to have an image density of 1.45 and color reproducibility of a*=−0.5, b*=0.2. Thus the image quality was comparable to that obtained by using the conventional carbon black toner. The image production was repeated for 60,000 runs. Good image quality was not obtainable after long runs. The results are summarized in Table 1.

Comparative Example 9

| | |
|---|---|
| Polyester resin | 64 parts |
| Polyethylene wax | 5 parts |
| TiFe Ferrite (number average particle diameter: 72 nm, saturation magnetization: 12 $Am^2/Kg$) | 30 parts |
| Negative charge controlling agent | 1 part |

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having a dielectric loss δ of $8\times10^{-3}$ and a true specific gravity of 1.54 $g/cm^3$ was selected. The selected toner particles (100 parts) were then mixed with 0.6 part of hydrophobic silica under the following conditions to obtain a toner.

Henschel mixer: Type 20B

Revolution speed of the mixer: 1890 rpm

Operation pattern: operated for 30 seconds and then stopped for 60 seconds

Mixing time: the above operation was conducted only once.

The thus obtained toner was found to have a detaching rate of 0.20%. The toner was charged in a toner container of an image forming machine (imagio MF2230 manufactured by Ricoh Company, Ltd.), and an image was produced. The image was found to have an image density of 1.23 and color reproducibility of a*=−0.1, b*=−0.5. Thus the image quality was comparable to that obtained by using the conventional carbon black toner. The image production was repeated for 60,000 runs. Good image quality was not obtainable after long runs. The results are summarized in Table 1.

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having a dielectric loss δ of $12\times10^{-3}$ and a true specific gravity of 1.44 $g/cm^3$ was selected. The selected toner particles (100 parts) were then mixed with 0.5 part of hydrophobic silica under the following conditions to obtain a toner.

Henschel mixer: Type 20B

Revolution speed of the mixer: 1890 rpm

Operation pattern: operated for 30 seconds and then stopped for 60 seconds

Mixing time: the above operation was repeated 12 times, namely, a total mixing time (T) was 360 seconds Clearance C between the tip of the blade and the inside wall: 0.01 m Peripheral speed v of the tip of the blade: 49.5 m/sec The (C×d)/(V×T) value (d represents the number average particle diameter of the black metal oxide) was thus $4.0\times10^{-14}$ m. The toner was charged in a toner container of an image forming machine (imagio MF2230 manufactured by Ricoh Company, Ltd.), and an image was produced. The image was found to have an image density of 1.35 and color reproducibility of a*=−0.1, b*=−0.5. Thus the image quality was comparable to that obtained by using the conventional carbon black toner. The image production was repeated for 60,000 runs. The 20,000th and 60,000th images were found to have good image quality (preciseness).

TABLE 1

| Example No. | Amount of Silica (part) | Detaching rate (wt. %) | Initial Image quality | Initial Image density | After 60000 image production Image quality | After 60000 image production Image density | After 60000 image production Toner scattering | After 60000 image production Background stains |
|---|---|---|---|---|---|---|---|---|
| 7 | 0.5 | 10.0 | good | 1.35 | good | 1.34 | none | none |
| 8 | 0.8 | 10.0 | good | 1.33 | good | 1.32 | none | none |
| 9 | 0.6 | 8.3 | good | 1.33 | good | 1.33 | none | none |
| 10 | 0.5 | 10.0 | good | 1.38 | good | 1.35 | none | none |
| 11 | 0.5 | 10.0 | good | 1.42 | good | 1.40 | none | none |
| 12 | 0.5 | 10.0 | good | 1.35 | good | 1.33 | none | none |
| 13 | 0.5 | 28.0 | good | 1.35 | good | 1.34 | none | none |
| Comp. 7 | 0.6 | 33.3 | good | 1.15 | no good | 1.11 | none | occurred |
| Comp. 8 | 0.6 | 33.3 | good | 1.45 | no good | 1.42 | occurred | occurred |
| Comp. 9 | 0.6 | 33.3 | good | 1.23 | no good | 1.20 | occurred | none |

EXAMPLE 14

| | |
|---|---|
| Polyester resin | 71 parts |
| Polyethylene wax | 5 parts |
| MnFe Ferrite (number average particle diameter: 72 nm, saturation magnetization: 0.2 $Am^2/Kg$) | 23 parts |
| Negative charge controlling agent | 1 part |

EXAMPLE 15

| | |
|---|---|
| Polyester resin | 71 parts |
| Polyethylene wax | 5 parts |
| MnFe Ferrite (number average particle diameter: 72 nm, saturation magnetization: 0.2 $Am^2/Kg$) | 23 parts |
| Negative charge controlling agent | 1 part |

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having a dielectric loss δ of $12\times10^{-3}$ and a true specific gravity of 1.44 g/cm$^3$ was selected. The selected toner particles (100 parts) were then mixed with 0.8 part of hydrophobic silica under the following conditions to obtain a toner.

Henschel mixer: Type 20B

Revolution speed of the mixer: 1890 rpm

Operation pattern: operated for 30 seconds and then stopped for 60 seconds

Mixing time: the above operation was repeated 12 times, namely, a total mixing time (T) was 360 seconds Clearance C between the tip of the blade and the inside wall: 0.005 m Peripheral speed V of the tip of the blade: 49.5 m/sec The (C×d)/(V×T) value (d represents the number average particle diameter of the black metal oxide) was thus $2.0\times10^{-14}$ m. The toner was charged in a toner container of an image forming machine (imagio MF2230 manufactured by Ricoh Company, Ltd.), and an image was produced. The image was found to have an image density of 1.33 and color reproducibility of a*=−0.1, b*=−0.5. Thus the image quality was comparable to that obtained by using the conventional carbon black toner. The image production was repeated for 60,000 runs. The 20,000th and 60,000th images were found to have good image quality (preciseness).

EXAMPLE 16

| | |
|---|---|
| Polyester resin | 76 parts |
| Carnauba wax | 5 parts |
| TiFe Ferrite (number average particle diameter: 96 nm, saturation magnetization: 3.0 Am$^2$/Kg) | 23 parts |
| Metal salt of salicylic acid compound | 3 parts |

The above composition was mixed using a Henschel mixer under various conditions to obtain premixed materials having different degrees of mixing state and each having a weight particle diameter of 9.0 μm. Each of the premixed materials was melted, kneaded with a dual axis kneader, solidified, ground and classified. From the thus obtained various kinds of toner particles having different degree of mixing state, one kind of toner particles having a dielectric loss δ of $3\times10^{-3}$ and a true specific gravity of 1.36 g/cm$^3$ was selected, The selected toner particles (100 parts) were then mixed with 0.6 part of hydrophobic silica under the following conditions to obtain a toner.

Henschel mixer: Type 20B

Revolution speed of the mixer: 1890 rpm

Operation pattern: operated for 30 seconds and then stopped for 60 seconds

Mixing time: the above operation was repeated 36 times, namely, a total mixing time (T) was 1080 seconds Clearance C between the tip of the blade and the inside wall: 0.01 m Peripheral speed V of the tip of the blade: 49.5 m/sec The (C×d)/(V×T) value (d represents the number average particle diameter of the black metal oxide) was thus $1.8\times10^{-14}$ m. The toner was charged in a toner container of an image forming machine (imagio MF2230 manufactured by Ricoh Company, Ltd.), and an image was produced. The image was found to have an image density of 1.33 and color reproducibility of a*=−0.1, b*=−0.2. Thus the image quality was comparable to that obtained by using the conventional carbon black toner. The image production was repeated for 60,000 runs. The 20,000th and 60,000th images were found to have good image quality (preciseness).

EXAMPLE 17

| | |
|---|---|
| Polyester resin | 74 parts |
| Polyethylene wax | 5 parts |
| $Fe_2O_3$—$Mn_2O_3$ (number average particle diameter: 55 nm, saturation magnetization: 2.0 Am$^2$/Kg) | 20 parts |
| Negative charge controlling agent | 1 part |

The above composition was mixed using a Henschel mixer under various conditions to obtain premixed materials having different degrees of mixing state and each having a weight particle diameter of 11.5 μm. Each of the premixed materials was melted, kneaded with a dual axis kneader, solidified, ground and classified. From the thus obtained various kinds of toner particles having different degree of mixing state, one kind of toner particles having a dielectric loss δ of $4\times10^{-3}$ and a true specific gravity of 1.41 g/cm$^3$ was selected. The selected toner particles (100 parts) were then mixed with 0.5 part of hydrophobic silica under the following conditions to obtain a toner.

Henschel mixer: Type 20B

Revolution speed of the mixer: 1890 rpm

Operation pattern: operated for 30 seconds and then stopped for 60 seconds

Mixing time: the above operation was repeated 12 times, namely, a total mixing time (T) was 360 seconds Clearance C between the tip of the blade and the inside wall: 0.01 m Peripheral speed V of the tip of the blade: 49.5 m/sec The (C×d)/(V×T) value (d represents the number average particle diameter of the black metal oxide) was thus $3.1\times10^{-14}$ m. The toner was charged in a toner container of an image forming machine (imagio MF2230 manufactured by Ricoh Company, Ltd.), and an image was produced. The image was found to have an image density of 1.38 and color reproducibility of a*=−0.1, b*=−0.3. Thus the image quality was comparable to that obtained by using the conventional carbon black toner. The image production was repeated for 60,000 runs. The 20,000th and 60,000th images were found to have good image quality (preciseness).

EXAMPLE 18

| | |
|---|---|
| Styrene-acrylate resin | 67 parts |
| Low molecular weight polypropylene | 5 parts |
| Titanium oxide sintered material (number average particle diameter: 30 nm, saturation magnetization: 0.5 Am$^2$/Kg) | 27 parts |
| Negative charge controlling agent | 1 part |

The above composition was mixed using a Henschel mixer under various conditions to obtain premixed materials having different degrees of mixing state and each having a weight particle diameter of 5.5 μm. Each of the premixed materials was melted, kneaded with a dual axis kneader, solidified, ground and classified. From the thus obtained various kinds of toner particles having different degree of mixing state, one kind of toner particles having a dielectric loss δ of $13\times10^{-3}$ and a true specific gravity of 1.51 g/cm$^3$ was selected. The selected toner particles (100 parts) were then mixed with 0.5 part of hydrophobic silica under the following conditions to obtain a toner.

Henschel mixer: Type 20B
Revolution speed of the mixer: 1890 rpm
Operation pattern: operated for 30 seconds and then stopped for 60 seconds
Mixing time: the above operation was repeated 24 times, namely, a total mixing time (T) was 720 seconds
Clearance C between the tip of the blade and the inside wall: 0.01 m
Peripheral speed V of the tip of the blade: 49.5 m/sec The (C×d)/(V×T) value (d represents the number average particle diameter of the black metal oxide) was thus $8.4\times10^{-14}$ m. The toner was charged in a toner container of an image forming machine (imagio MF2230 manufactured by Ricoh Company, Ltd.), and an image was produced. The image was found to have an image density of 1.42 and color reproducibility of a*=−0.2, b*=−0.3. Thus the image quality was comparable to that obtained by using the conventional carbon black toner. The image production was repeated for 60,000 runs. The 20,000th and 60,000th images were found to have good image quality (preciseness).

EXAMPLE 19

| | |
|---|---|
| Polyester resin | 54 parts |
| Carbauna wax | 5 parts |
| TiFe Ferrite (number average particle diameter: 96 nm, saturation magnetization: 3.0 Am$^2$/Kg) | 16 parts |
| Metal salt of salicylic acid compound | 3 parts |

The above composition was mixed using a Henschel mixer under various conditions to obtain premixed materials having different degrees of mixing state and each having a weight particle diameter of 9.0 μm. Each of the premixed materials was melted, kneaded with a dual axis kneader, solidified, ground and classified. From the thus obtained various kinds of toner particles having different degree of mixing state, one kind of toner particles having a dielectric loss δ of $3\times10^{-3}$ and a true specific gravity of 1.36 g/cm$^3$ was selected. The selected toner particles (100 parts) were then mixed with 0.5 part of hydrophobic silica under the following conditions to obtain a toner.

Henschel mixer: Type 20B
Revolution speed of the mixer: 1890 rpm
Operation pattern: operated for 30 seconds and then stopped for 60 seconds
Mixing time: the above operation was repeated 4 times, namely, a total mixing time (T) was 720 seconds
Clearance C between the tip of the blade and the inside wall: 0.01 m
Peripheral speed V of the tip of the blade: 49.5 m/sec The (C×d)/(V×T) value (d represents the number average particle diameter of the black metal oxide) was thus $2.7\times10^{-14}$ m. The toner was charged in a toner container of an image forming machine (imagio MF2230 manufactured by Ricoh Company, Ltd.), and an image was produced. The image was found to have an image density of 1.35 and color reproducibility of a*=−0.0, b*=−0.2. Thus the image quality was comparable to that obtained by using the conventional carbon black toner. The image production was repeated for 60,000 runs. The 20,000th and 60,000th images were found to have good image quality (preciseness).

EXAMPLE 20

| | |
|---|---|
| Polyester resin | 71 parts |
| Polyethylene wax | 5 parts |
| MnFe Ferrite (number average particle diameter: 72 nm, saturation magnetization: 0.2 Am$^2$/Kg) | 23 parts |
| Negative charge controlling agent | 1 part |

The above composition was mixed using a Henschel mixer under various conditions to obtain premixed materials having different degrees of mixing state and each having a weight particle diameter of 7.0 μm. Each of the premixed materials was melted, kneaded with a dual axis kneader, solidified, ground and classified. From the thus obtained various kinds of toner particles having different degree of mixing state, one kind of toner particles having a dielectric loss δ of $12\times10^{-3}$ and a true specific gravity of 1.44 g/cm$^3$ was selected. The selected toner particles (100 parts) were then mixed with 0.5 part of hydrophobic silica under the following conditions to obtain a toner.

Henschel mixer: Type 20B
Revolution speed of the mixer: 1890 rpm
Operation pattern: operated for 30 seconds and then stopped for 60 seconds
Mixing time: the above operation was repeated 12 times, namely, a total mixing time (T) was 360 seconds
Clearance C between the tip of the blade and the inside wall: 0.01 m
Peripheral speed V of the tip of the blade: 49.5 m/sec The (C×d)/(V×T) value (d represents the number average particle diameter of the black metal oxide) was thus $4.0\times10^{-14}$ m. The toner was charged in a toner container of an image forming machine (imagio MF2230 manufactured by Ricoh Company, Ltd.), and an image was produced. The image was found to have an image density of 1.35 and color reproducibility of a*=−0.1, b*=−0.5. Thus the image quality was comparable to that obtained by using the conventional carbon black toner. The image production was repeated for 60,000 runs. The 20,000th and 60,000th images were found to have good image quality (preciseness).

EXAMPLE 21

| | |
|---|---|
| Polyester resin | 74 parts |
| Polyethylene wax | 5 parts |
| $Fe_2O_3$—$Mn_2O_3$ (number average particle diameter: 55 nm, saturation magnetization: 2.0 Am$^2$/Kg) | 20 parts |
| Negative charge controlling agent | 1 part |

The above composition was mixed using a Henschel mixer under various conditions to obtain premixed materials having different degrees of mixing state and each having a weight particle diameter of 12.5 μm. Each of the premixed materials was melted, kneaded with a dual axis kneader, solidified, ground and classified. From the thus obtained various kinds of toner particles having different degree of mixing state, one kind of toner particles having a dielectric loss δ of $4\times10^{-3}$ and a true specific gravity of 1.41 g/cm$^3$ was selected. The selected toner particles were used as a toner. The toner was charged in a toner container of an image forming machine (imagio MF2230 manufactured by Ricoh Company, Ltd.), and an image was produced. The image was found to have an image density of 1.30 and color reproducibility of a*=−0.1, b*=−0.3. Thus the image quality was comparable to that obtained by using the conventional carbon black toner. The consumption of the toner and carrier service life were tested by repeatedly producing images for long runs. The results were similar to those obtained by using the conventional carbon black toner.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Applications No. 2002-056315, filed Mar. 1, 2002, and No. 2002-210813, filed Jul. 19, 2002, inclusive of the specification, claims and drawings, are hereby incorporated by reference herein.

What is claimed is:

1. A toner, comprising:

toner particles each comprising a black colorant and a binder resin, wherein said black colorant comprises a metal oxide having a number average particle diameter in the range of 20 to 100 nm in an amount of 10 to 40% by weight based on a total weight of said toner particles;

wherein said toner has a dielectric loss in the range of $3\times10^{-3}$ to $15\times10^{-3}$; and wherein the toner has a saturation magnetization of not greater than 10 Am$^2$/Kg.

2. The toner as claimed in claim 1, wherein the amount of said metal oxide is in the range of 10 to 30% by weight.

3. The toner as claimed in claim 1, further comprising:

an external additive of fine metal oxide powder in an amount of 0.2 to 5.0% by weight based on the weight of said toner particles, said fine metal oxide powder being attached to said toner particles, wherein, when the toner is sonicated in an aqueous medium containing 1% by weight of a surfactant at a frequency of 38 kHz and a power of 120 W for 10 minutes, said fine metal oxide powder is detached from said toner particles in an amount of 30% by weight or less based on the weight of said fine metal powder before said toner is sonicated.

4. The toner as claimed in claim 1, further comprising:

an external additive of fine metal oxide powder attached to said toner particles by being mixed with said toner particles using a Henschel mixer for a period of time of T in seconds, said mixer comprising an inside wall defining a mixing chamber, and a rotating blade having a tip portion and being disposed in said mixing chamber so that a clearance C in m is defined between said tip portion and said inside wall, said mixer being operated so that said tip portion of said rotating blade moves at a peripheral speed of V in m/sec, wherein said clearance C, peripheral speed V and mixing time T satisfy the following condition:

$$(C\times d)/(V\times T)\leqq 5\times10^{-13} \text{ in m}$$

wherein d is the number average particle diameter of said metal oxide in unit meter.

5. The toner as claimed in claim 4, wherein said clearance C is 0.001 to 0.02 m.

6. The toner as claimed in claim 4, wherein V is 5 to 100 m/sec.

7. A toner container, comprising:

said toner according to claim 1.

8. An image forming apparatus, comprising:

said toner container according to claim 7.

9. An image forming method, comprising:

developing an electrostatic latent image with said toner according to claim 1.

10. The toner as claimed in claim 1, wherein said metal oxide is an oxide of at least one metal selected from the group consisting of Al, Si, Ti, V, Mn, Fe, Co, Cu, Nb, Mo, Sn and mixtures thereof.

11. The toner as claimed in claim 1, wherein said binder resin is selected from the group consisting of polystyrene resins, epoxy resins and mixtures thereof.

12. The toner as claimed in claim 1, further comprising a wax.

13. The toner as claimed in claim 1, further comprising 0–20% of a wax based on the weight of the toner.

14. The toner as claimed in claim 1, further comprising 0.1 to 20% of a charge controlling agent based on the weight of the toner.

15. The toner as claimed in claim 1, further comprising an inorganic fine particle having a primary particle diameter of 5 nm to 2 μm.

16. The toner as claimed in claim 1, comprising a hydrophobic fine metal oxide powder as external additive.

17. The toner as claimed in claim 1, having a bulk density of 0.200 g/cm$^3$ to 0.500 g/cm$^3$.

* * * * *